US008889085B2

(12) United States Patent
Lee et al.

(10) Patent No.: US 8,889,085 B2
(45) Date of Patent: Nov. 18, 2014

(54) MICROFLUIDIC CHANNEL FOR REMOVING BUBBLES IN FLUID

(75) Inventors: Woochang Lee, Anyang-si (KR); Jae Yeon Jung, Hwaseong-si (KR); Youn Suk Choi, Yongin-si (KR); Young Ki Hahn, Seoul (KR); Sang Kyu Kim, Yongin-si (KR); Soo Suk Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 258 days.

(21) Appl. No.: 13/303,503

(22) Filed: Nov. 23, 2011

(65) Prior Publication Data

US 2013/0004385 A1 Jan. 3, 2013

(30) Foreign Application Priority Data

Jun. 29, 2011 (KR) ..... 10-2011-0063954

(51) Int. Cl.
*B01L 99/00* (2010.01)
*B01L 3/00* (2006.01)

(52) U.S. Cl.
CPC ..... *B01L 3/502723* (2013.01); *B01L 2400/043* (2013.01); *B01L 2400/0677* (2013.01); *B01L 2200/0684* (2013.01); *B01L 2300/0867* (2013.01); *B01L 2200/0647* (2013.01); *B01L 2300/0816* (2013.01); *B01L 2400/0409* (2013.01)
USPC ..... 422/506; 422/503; 436/180

(58) Field of Classification Search
CPC ..... B01L 2400/0409
USPC ..... 422/502–506; 436/180
See application file for complete search history.

(56) References Cited

U.S. PATENT DOCUMENTS

| | | | | |
|---|---|---|---|---|
| 7,586,612 | B2 | 9/2009 | Savatic et al. | |
| 2002/0151078 | A1* | 10/2002 | Kellogg et al. | 436/45 |
| 2005/0196779 | A1* | 9/2005 | Ho et al. | 435/6 |
| 2006/0263265 | A1* | 11/2006 | Kang et al. | 422/101 |
| 2007/0149925 | A1* | 6/2007 | Edwards et al. | 604/141 |

FOREIGN PATENT DOCUMENTS

| | | | |
|---|---|---|---|
| EP | 1 792 655 | A1 | 6/2007 |
| EP | 1 813 683 | A1 | 8/2007 |
| EP | 1 855 114 | A1 | 11/2007 |
| WO | 2006/092959 | A1 | 9/2006 |

OTHER PUBLICATIONS

J. Xu et al., "Use of a porous membrane for gas bubble removal in microfluidic channels: physical mechanisms and design criteria," Microfluid Nanofluid. Published online: Mar. 24, 2010.

A.M. Skelley & J. Voldman, "An active bubble trap and debubler for microfluidic systems," LabChip 2008, 8, 1733-1737.

* cited by examiner

*Primary Examiner* — Paul Hyun
(74) *Attorney, Agent, or Firm* — Leydig, Voit & Mayer, Ltd.

(57) ABSTRACT

A microfluidic channel for effectively removing a gas from a fluid, and microfluidic apparatus including the same are provided. The microfluidic channel includes a first channel having a uniform cross-sectional area, and a second channel connected to the first channel and having a gradually expanded cross-sectional area.

17 Claims, 8 Drawing Sheets

MICROFLUIDIC CHANNEL FOR REMOVING BUBBLES IN FLUID

CROSS-REFERENCE TO RELATED APPLICATION

This application claims priority to Korean Patent Application No. 10-2011-0063954, filed on Jun. 29, 2011, and all the benefits accruing therefrom under 35 U.S.C. §119, the content of which in its entirety is herein incorporated by reference.

BACKGROUND

1. Field

Provided is a microfluidic channel for removing bubbles in a fluid and a microfluidic apparatus including the same.

2. Description of the Related Art

There has been a growing interest in the manufacture and use of microfluidic apparatuses for the acquisition of chemical and biological information.

A microfluidic apparatus is used to analyze and measure chemical, biological, or physical characteristics of a fluid on a micro-scale or meso-scale level in the fields of physics, chemistry, biochemistry and bioengineering. The microfluidic apparatus may use a small amount of reagent and shorten a reaction time.

Samples and reagents, etc., used in a microfluidic apparatus are stored at low temperatures in advance and heated on use. As the temperature of the sample increases, there is a decrease in the saturation solubility of oxygen, nitrogen and other such gas components dissolved in the sample, and any gaseous components dissolved at over the saturation solubility produce bubbles inside the microfluidic channel.

As a result, the bubbles can partially or even totally block the microfluidic channel, which impedes the flow of the fluid and makes the fluid more difficult to control. Also, when the microfluidic apparatus is used to measure the amount of a sample, the generation of bubbles makes it difficult to measure accurately the amount of the sample.

Therefore, it is necessary to develop a microfluidic channel capable of reducing or removing bubbles generated in a fluid flowing through a microfluidic channel.

SUMMARY

A microfluidic channel for removing bubbles in a fluid is provided.

Provided is a microfluidic channel for removing bubbles in a fluid. The microfluidic channel includes a first channel having a uniform cross-sectional area, and a second channel which is connected to the first channel and has a gradually increasing cross-sectional area.

Provided is a microfluidic apparatus including a substrate which is driven by centrifugal force, a fluid injector, a fluid container which is connected to the fluid injector, a first channel having a uniform cross-sectional area which is connected to the fluid container, and a second channel which is connected to the first channel and has a gradually increasing cross-sectional area, and a valve for controlling the flow of a fluid.

Due to the channel having a gradually expanded structure by the gradually increasing cross-sectional area, a gas may be efficiently separated and removed from the fluid.

BRIEF DESCRIPTION OF THE DRAWINGS

The above and other aspects, advantages and features of this invention will become more apparent by describing in further detail embodiments thereof with reference to the accompanying drawings, in which.

DETAILED DESCRIPTION

Figure 1:
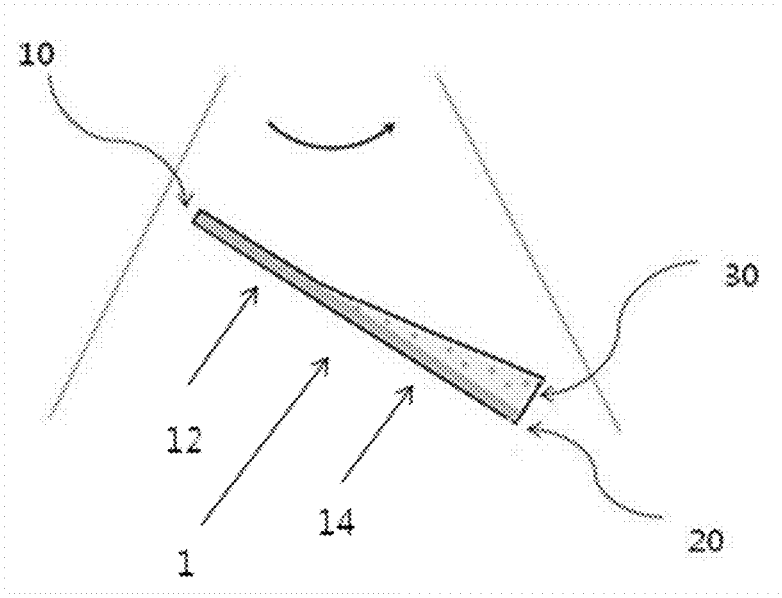
FIG. 1 is a schematic view of a microfluidic channel according to an embodiment.

The invention now will be described more fully hereinafter with reference to the accompanying drawings, in which a non-limiting embodiment is shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" or "connected to" another element, it can be directly on the other element or intervening elements may be present therebetween. In contrast, when an element is referred to as being "directly on" or "directly connected to" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated regions, integers, steps, operations, elements, and/or components, but do not preclude the presence or addition of one or more other regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

One or more embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear portions. Moreover, sharp angles that are illustrated may be rounded. Thus, the regions illustrated in the figures are schematic in nature and their shapes are not intended to illustrate the precise shape of a region and are not intended to limit the scope of the claims.

Generation of bubbles in a microfluidic channel may affect the uniformity of an analysis reaction, and preclude precise transfer of a fluid and control of the flow velocity of the fluid.

In general, to remove bubbles from the microfluidic channel, a passive method (J. Xu et al., Microfluid Nanofluid. 2010) and an active method (A. M. Skelley & J. Voldman, LabChip 2008, 8, 1733-1737) have been employed. The passive method may include forming a hydrophobic layer on a microfluidic channel to suppress the flow of a fluid and capture bubbles of the fluid. The active method may include removing bubbles using gas permeability of polydimethylsiloxane ("PDMS").

However, the passive method should be performed under various restricted conditions, for example, a size of bubbles, a time for which a fluid mixed with bubbles stays in a microfluidic channel, a flow velocity, and a pressure. Also, to control the flow of a fluid, even if any one condition exceeds a critical value, bubbles may flow out from a bubble capturing region.

Furthermore, since the active method is based on diffusion of gases passing through PDMS, it may take a larger amount of time than in the passive method to remove bubbles. Also, several driving elements may be needed to remove bubbles, and peripheral gas concentrations may vary to adopt the driving elements. Accordingly, the active method may be neither used for cultivation of microfluidic cells, which may be greatly affected by actual bubbles and the concentrations of dissolved gases, nor widely applied because methods and targets capable of increasing efficiency are limited.

On an experimental basis, when it takes a large amount of time to remove generated bubbles, the activity of a prepared bio material may be degraded. Also, when a solution containing bio-molecules such as protein is stored in or exposed to a fluidic apparatus manufactured by shaping a polymer material, nonspecific adsorption may occur, thereby lowering the concentration of a target material required for an actual reaction.

Therefore, to analyze a target material precisely and rapidly, it is necessary to develop a microfluidic channel and method for removing bubbles generated in a microfluidic channel.

According to an embodiment, a microfluidic channel capable of removing bubbles from a fluid due to a structure having a gradually expanded cross-sectional area is provided. The microfluidic channel may include a first channel, and a second channel having a gradually expanded cross-sectional area which is physically and/or fluidly connected to the first channel.

As used herein, the term "fluid" refers to a flowable substance that has no unfixed shape, and may include liquids and gases.

Typically, a fluid may be a substance that continually deforms under an applied a static shear stress. Thus, when applied with the static shear stress, the fluid may be continuously and permanently distorted. The fluid may have any density as long as the fluid is able to flow.

The fluid may include protein, DNA ("Deoxyribonucleic acid"), RNA ("Ribonucleic acid"), peptides, carbohydrates, bacteria, plants, mold, or animal cells, but is not limited thereto.

According to the above embodiment, the fluid is not intended to be any specific fluid.

As used interchangeable herein, the term "gas" or bubble" refers to portions surrounded by the fluid or isolated from one another.

As used interchangeable herein, the term "microfluidic channel" or "channel" refers to a fluid flow channel having a size dimension such that a fluid flowing through the microfluidic channel is affected by centrifugal force and exhibits different behaviors from a fluid flowing through a channel with a typical dimension of a conventional channel.

The microfluidic channel may be a tube such as a flexible tube or a capillary tube.

As used herein, the term "first channel" refers to a fluid flow channel having a uniform cross-sectional area or the same cross-sectional area taken in a direction perpendicular to a direction in which the fluid flows.

The first channel may be inclined with respect to a rotation axis with respect to a plane to enable a drift due to centrifugal force. In one embodiment, for example, the first channel may be inclined to have an angle of less than about 90°, less than about 80°, less than about 70°, less than about 60°, less than about 50°, less than about 40°, less than about 30°, less than about 20°, or less than about 10° with respect to the rotation axis.

The first channel may have an arbitrary cross-sectional shape in consideration of the purpose and size thereof. In an embodiment, for example, the cross-sectional shape of the first channel may include a circular shape, an elliptical shape, a triangular shape, a tetragonal shape, a pentagonal shape, a hexagonal shape or an irregular shape, but is not limited thereto.

The first channel may include not only an inorganic material such as glass or silicon, but also a polymer such as silicon rubber, isobonyl acrylate, polyethylene terephthalate, PDMS, poly methyl methacrylate, polycarbonate, polypropylene, polystyrene, polyvinyl chloride, polysiloxane, polyimide or polyurethane, but is not limited thereto.

The first channel may have appropriate cross-sectional area and length as to enable flow of the fluid without any particular limitation. In an embodiment, for example, the cross-sectional area of the microfluidic channel may be about 1 square millimeter ($mm^2$) or less, about 500 square micrometers ($\mu m^2$) or less, about 100 $\mu m^2$ or less, about 50 $\mu m^2$ or less, about 10 $\mu m^2$ or less, about 5 $\mu m^2$ or less, or about 1 $\mu m^2$ or less. The length of the microfluidic channel may be about 100 millimeters (mm) or less, about 50 mm or less, or about 10 mm or less.

The material, shape, cross-sectional area, and length of the first channel is not intended to be any specific material, shape, cross-sectional area, and length, respectively.

As used herein, the term "second channel having a gradually expanded cross-sectional area" refers to a fluid flow channel having a cross-sectional area taken in a direction perpendicular to a direction in which the fluid flows, that increases gradually or stepwise in the direction in which the fluid flows.

The second channel may have an angle of less than about 90°, less than about 80°, less than about 70°, less than about 60°, less than about 50°, or less than about 40° with respect to a lengthwise direction of the first channel and a gradually expanded cross-sectional area.

The second channel may include the same or different material from the first channel. The second channel may include not only an inorganic material such as glass or silicon, but also a polymer such as silicon rubber, isobonyl acrylate, polyethylene terephthalate, PDMS, poly methyl methacrylate, polycarbonate, polypropylene, polystyrene, polyvinyl chloride, polysiloxane, polyimide, or polyurethane, but is not limited thereto.

The cross-sectional shape of the second channel may include a circular shape, an elliptical shape, a triangular shape, a tetragonal shape, a pentagonal shape, a hexagonal shape, or an irregular shape, but is not limited thereto.

The cross-sectional area of the second channel may be about 1 $mm^2$ or less, about 500 $\mu m^2$ or less, about 100 $\mu m^2$ or less, about 50 $\mu m^2$ or less, about 10 $\mu m^2$ or less, about 5 $\mu m^2$ or less, or about 1 $\mu m^2$ or less, but is not limited thereto.

The second channel may be installed in a lengthwise direction of a portion of the first channel, that is, disposed along the direction in which the fluid flows. The length of the second channel may be 80% or less, 70% or less, 60% or less, or 50% or less of the length of the first channel, but is not limited thereto.

The material, shape, cross-sectional area, and length of the second channel is not intended to be any specific material, shape, cross-sectional area, and length, respectively.

The first and second channels may be combined with each other by a lamination process using a double-sided tape, a bonding process using an adhesive and surface reformation, or an ultrasonic fusion process, but the combination process is not limited thereto. The first and second channels may be connected directly to each other to form a continuous fluid path through the microfluidic channel.

According to the embodiment, the microfluidic apparatus may include the first channel having the uniform cross-sectional area and the second channel having the gradually expanded cross-sectional area and be driven by centrifugal force. When a fluid is injected into the microfluidic apparatus, a gas and a liquid may be separated from each other due to a difference between pressures applied to the gas and the liquid at a spot where the second channel is gradually expanded. A schematic view of the microfluidic channel according to the embodiment is shown in FIG. 1.

Referring to FIG. 1, in the microfluidic channel 1 including the first channel 12 having the uniform cross-sectional area and the second channel 14 having the gradually expanded cross-sectional area, the average flow velocity ($\overline{\upsilon}$) of the fluid is proportional to the square of angular velocity and the cross-sectional area of the fluid:

$$\overline{\upsilon} = \frac{\rho}{32\eta}\bar{r}d^2\omega^2, \tag{1}$$

wherein ρ represents the mass density of a fluid, r represents the distance from a central axis, d represents the diameter of the fluid, ω represents the angular velocity of the fluid, and η represents the viscosity of the fluid.

The second channel 14 is in direct fluid communication with the first channel 12. A lower wall of the second channel 14 and a lower wall of the first channel 12 may be substantially coplanar with each other. An upper wall of the second channel 14 may extend at an angle from the upper wall of the first channel 12.

A discharge $Q_1$ (refer to 10) of the fluid into the microfluidic channel 1 at an entrance or inlet of the microfluidic channel 1 is equal to a discharge $Q_2$ (refer to 20) of the fluid at an exit or outlet thereof as shown in Equation 2:

$$Q=\overline{\upsilon}A=Q_1\approx Q_2 \tag{2},$$

wherein $\overline{\upsilon}$ represents the average flow velocity of the fluid, and A represents the cross-sectional area of the fluid.

A pressure may be applied by centrifugal force to the entire rotation target according to a radius of gyration so that the pressure can be applied to both a liquid and a gas within the expanding dimension microfluidic channel. Accordingly, the applied pressure may depend on the density of the fluid at the same position as shown in Equation 3:

$$\Delta p_\omega=\rho\bar{r}\Delta r\omega^2 \tag{3},$$

wherein ρ represents the density of the fluid, r represents the distance of the fluid from a central axis, Δr represents a variation in distance of the fluid, and ω represents the angular velocity of the fluid.

Referring again to FIG. 1, the microfluidic channel 1 may be rotated as indicated by the curved arrow.

When the fluid injected into the microfluidic channel 1 is a mixture containing both a liquid and a gas, since the flow velocity of the fluid may be reduced in an expanded portion of the microfluidic channel 1, a high pressure may be selectively applied to the liquid. As a result, the liquid may flow along a lower wall of the microfluidic channel 1 at the same rate as a discharge ($Q_1$, 10) of the liquid in an entrance of the microfluidic channel 1, and the gas 30 may stay in the expanded portion of the microfluidic channel 1 so that the gas 30 may be separated from the liquid.

Accordingly, the fluid may be intentionally induced to not flow through the entire microfluidic channel 1 but only into a predetermined portion of the microfluidic channel 1 so that unnecessary gases may be separated from the liquid. Also, by use of centrifugal force, bubbles may be removed in a short amount of time with high efficiency.

The microfluidic channel 1 may further include a barrier disposed at a terminal of the first channel 12 adjacent to the second channel 14, or within the second channel 14.

As used herein, the term "barrier" refers to any layer which is able to efficiently reduce the flow velocity of the fluid and is able to hinder the flow of the fluid from the first channel 12 into the second channel 14.

The barrier may include a hydrophobic porous layer. In one embodiment, for example, the barrier may include polycaprolactone, polystyrene, propylene carbonate, ethylene carbonate, dimethylcarbonate, diethylcarbonate, dibutyl phthalate, dioctyl phthalate, diisooctyl phthalate, diheptylnonyl phthalate, tritolylphospate or dioctyl adipate, but is not limited thereto.

The barrier is not intended to be any specific barrier.

The microfluidic channel 1 may further include a ventilation unit.

As used herein, the term "ventilation unit" refers to a pipe or hollow member connected to the outside the microfluidic channel 1, to enable smooth discharge of gases.

The ventilation unit may extend from a top portion of a terminal end of the microfluidic channel 1 (e.g., a discharge (Q2, 20 thereof) to the outside of the microfluidic channel 1. Alternatively, the ventilation unit may have a curved shape extending from the terminal end of the microfluidic channel 1 at a right angle to the rotation axis, and an upper portion of the curved shape of the ventilation unit may be connected to the outside of the microfluidic channel 1.

According to another embodiment, a microfluidic apparatus including the microfluidic channel is provided. The microfluidic apparatus may include a substrate, a fluid injector, a fluid container which is connected to the fluid injector, a first channel having a uniform cross-sectional area which is connected to the fluid container, a second channel having a gradually expanded cross-sectional area which is connected to the first channel, and a valve for controlling the flow of the fluid.

Hereinafter, the microfluidic apparatus will be described with reference to FIGS. 2 and 3.

As used herein, the term "substrate (not shown)" may refer to a unit being driven by centrifugal force, which may be obtained by rotating the substrate about a rotational axis. The substrate may include a rotation unit for rotating the substrate about the rotational axis or a control unit for controlling the rotation unit. In one embodiment, for example, the rotation unit may include a motor or a servo-motor, but is not limited thereto.

Referring again to FIG. 1, due to rotation of the substrate, centrifugal force may be applied to the fluid from an upper portion of the substrate close to the rotation axis toward a lower portion of the substrate far from the rotation axis so that the fluid can move from the upper portion of the substrate toward the lower portion thereof.

The shape of the substrate may include a circular shape, a triangular shape, a tetragonal shape, a pentagonal shape, a hexagonal shape or an irregular shape, but is not limited thereto.

The substrate is not intended to be any specific substrate.

As used herein, the term "fluid injector" refers to a unit for injecting a fluid into the microfluidic channel.

The shape of the fluid injector 100 may include a circular shape, a triangular shape, a tetragonal shape, a pentagonal shape, a hexagonal shape or an irregular shape, but is not limited thereto.

The fluid injector 100 may have a width of about 1 mm to about 2 mm. When the fluid injector 100 has a width of less than about 1 mm, the fluid may not be smoothly injected. When the fluid injector 100 has a width of more than about 2 mm, it may be difficult to control the velocity of the fluid injected into the microfluidic channel.

As used herein, the term "fluid container" refers to a unit where the fluid injected by the fluid injector 100 stays for a predetermined amount of time before the fluid is injected into the microfluidic channel.

Time for which the fluid stays in the fluid container 200 may depend on the injection rate, viscosity, and amount of the fluid.

While staying in the fluid container 200, the fluid may continuously flow into the microfluidic channel. Also, when the fluid injector 100 stops injecting the fluid, the fluid may be congested within the fluid container 200.

As used herein, the term "valve" refers to a unit installed on top of the microfluidic channel and configured to control the flow of the fluid. The valve may be a closed valve configured to cut off the flow of the fluid and be opened due to external energy.

The external energy may be, for example, electromagnetic waves, and an energy source may be a laser source for irradiating laser beams, an emission device for irradiating visible or infrared light, or a xenon lamp. A source of the external energy may be selected according to the wavelength of electromagnetic waves that may be absorbed by heating particles included in a material of the valve 300.

The material of the valve may be a phase-change material whose phase varies with energy or a thermoplastic resin. The phase-change material may be, for example, wax or gel. Also, the material of the valve may include micro-heating particles distributed in a phase-change material and used to absorb energy of the electromagnetic waves and generate heat. The micro-heating particles may be particles of a metal oxide such as $Al_2O_3$, $TiO_2$, $Ta_2O_3$, $Fe_2O_3$, $Fe_3O_4$, and $HfO_2$, polymer particles, quantum dots, or magnetic beads, but are not limited thereto.

The first channel 350 having the uniform cross-sectional area, which is connected to the fluid container 100, and the second channel 400 having the gradually expanded cross-sectional area which is connected to the first channel 350, are the same as above.

The microfluidic channel may further include ventilation units 500 and 600 to enable smooth discharge of gases.

Figure 2:
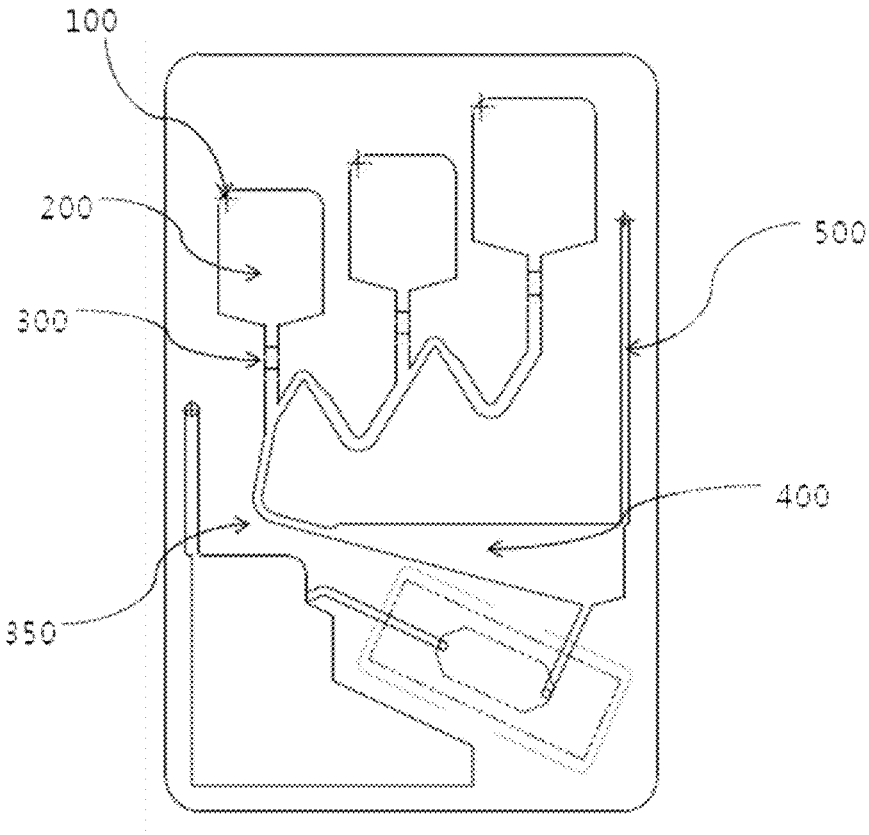
FIG. 2 illustrates a microfluidic apparatus according to an embodiment.
Figure 3:
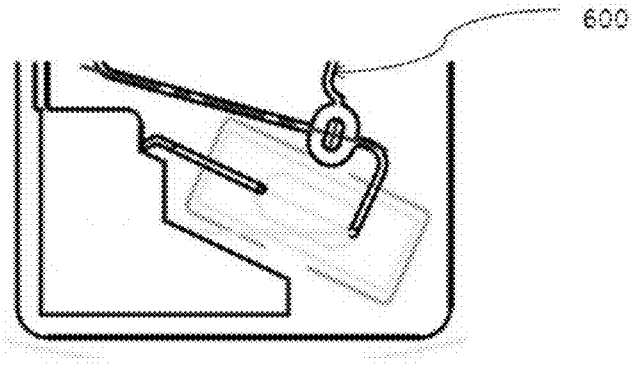
FIG. 3 illustrates a microfluidic apparatus according to another embodiment.

According to one embodiment, the ventilation unit 500 may extend from a top portion of a terminal end of the microfluidic channel to the outside (refer to FIG. 2). According to another embodiment, the ventilation unit 600 may have a curved shape at the terminal of the microfluidic channel at a right angle to the rotation axis and an upper portion of the curved shape of the ventilation unit 600 may be connected to the outside (refer to FIG. 3).

The microfluidic apparatus may be prepared by a microfabrication process, a hard micromachining process, a soft micromachining or soft lithography process.

The microfabrication process may include repetitively performing a thin-film deposition process, a lithography process, and an etching process on a multilayered structure. The thin-film deposition process may be performed using an oxidation process, a chemical deposition process, a physical deposition process, or an electroplating process. The lithography process may include transferring a pattern on a substrate such as a silicon substrate or glass substrate. Also, the etching process may include a wet etching process or a dry etching process such as a high-pressure plasma etching process, a reactive ion beam etch ("RIE") process or an ion milling process.

In one embodiment, for example, the microfluidic apparatus may include carbonate. An upper layer of the microfluidic apparatus may include the fluid injector 100, while a lower layer thereof may include the fluid container 200 and the second channel 400 of the microfluidic channel. The fluid injector 100, the fluid container 200, and the second channel 400 may be manufactured using a typical computer numerical control ("CNC") system. The upper and lower layers of the microfluidic apparatus may be bonded to each other using a double-sided tape (FLEXmount® DFM 200). The microfluidic apparatus may have a peripheral dimension of 28 mm×43 mm×9 mm. A rotation substrate for installing the microfluidic apparatus may be manufactured in the same manner as above.

To control the flow of the fluid, the valve 300 may include ferro-wax installed at a top end of the microfluidic channel. Ferro-wax may be heated at a temperature of about 80° C. or higher, and then provided to a bottom end of the fluidic container 200. When the ferro-wax is injected to the bottom end of the fluid container 200, the ferro-wax may move into the microfluidic channel due to capillary force and rapidly solidify due to emission of heat.

When a microfluidic cartridge including the microfluidic channel having the gradually expanded cross-sectional area is applied to a centrifugal microfluidic device, 90% or more, 94% or more, 96% or more, or 98% or more of bubbles may be removed.

Accordingly, since a target material may be analyzed precisely and rapidly, the reliability and reproducibility of a centrifugal microfluidic-device platform may be improved using a relatively simple structure.

Hereinafter, the embodiments will be described in further detail with reference to Embodiments, Examples, Comparative Examples. The following examples are merely to explain the embodiments, not to limit the embodiments.

COMPARATIVE EXAMPLE

Figure 4:
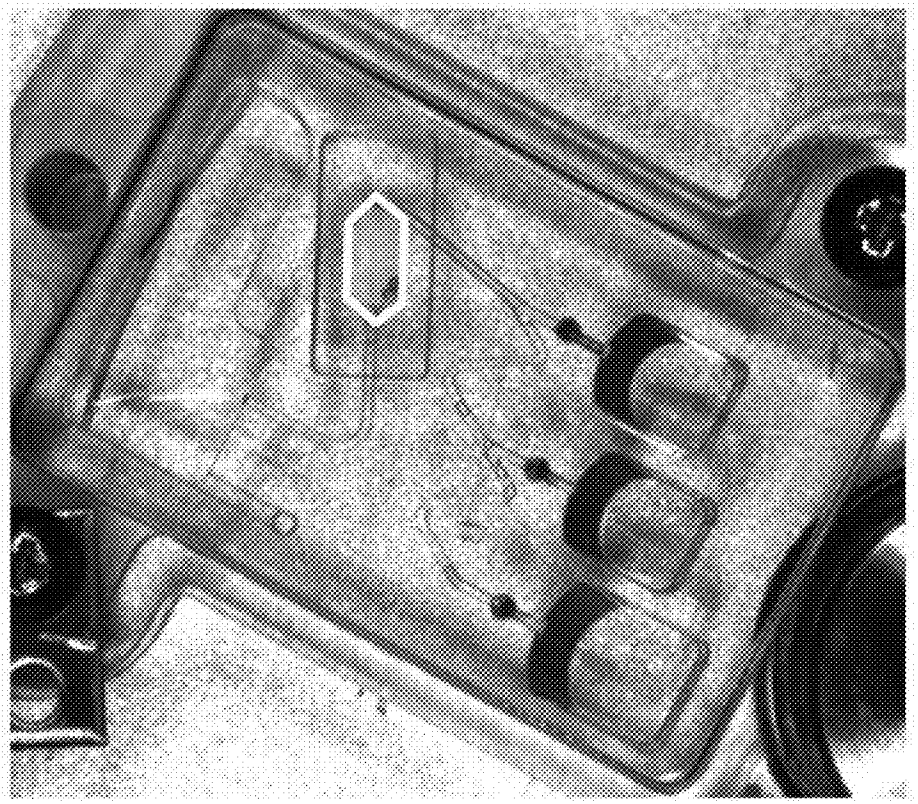
FIG. 4 is a photograph showing bubbles generated in a microfluidic channel according to a comparative example.
Figure 5:
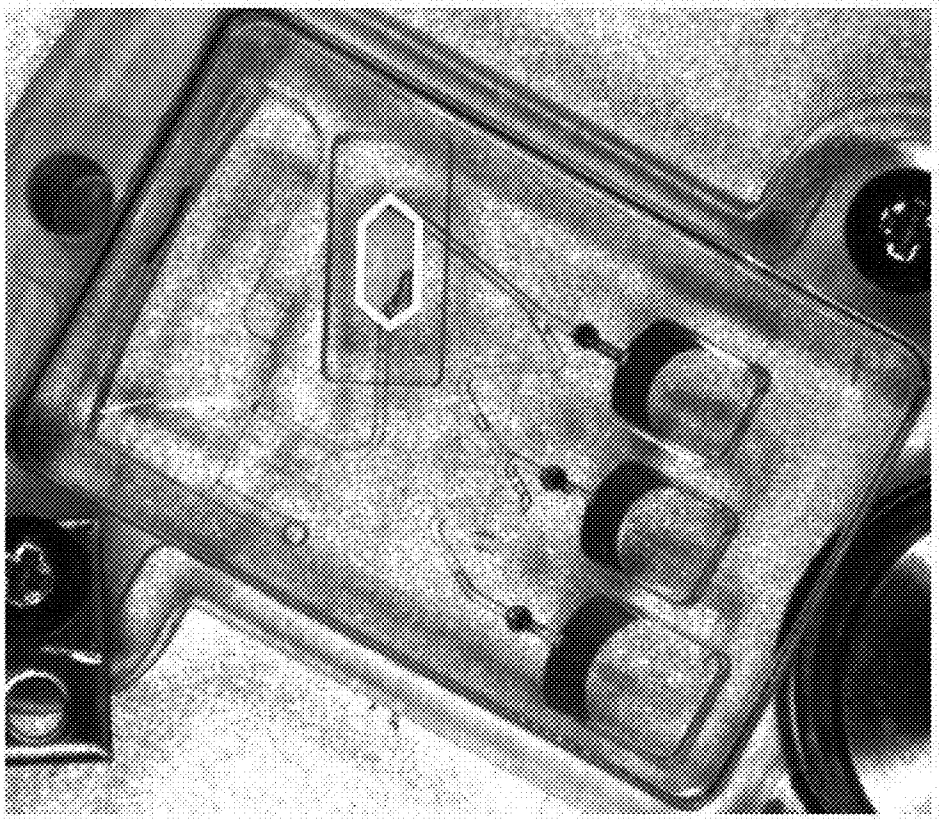
FIG. 5 is another photograph showing bubbles generated in the microfluidic channel according to the comparative example.

Removal of Bubbles from a Microfluidic Channel Having a Uniform Cross-Sectional Area To confirm the flow of bubbles into a microfluidic cartridge including a microfluidic channel having a uniform cross-sectional area, 5% of a bovine serum albumin ("BSA") solution and ink are sequentially injected, and maintained at a rate of 1000 revolutions per minute (rpm) for about 30 seconds, and then an image of bubbles is captured using a high-speed camera (IK-TF5, Toshiba, Japan) as shown in FIGS. 4 and 5.

From FIG. 4, it is observed that bubbles are injected from the microfluidic channel into a sensor pad, as indicated by the six-sided white outline. Also, from FIG. 5, it can be seen that even immediately after the fluid is completely emitted from the microfluidic channel, the bubbles are continuously injected into the sensor pad and congested in the sensor pad due to pressure induced by centrifugal force, as indicated by the six-sided white outline.

EXAMPLE

Removal of Bubbles from a Microfluidic Channel Having a Gradually Expanded Cross-Sectional Area The same method is performed as in Comparative example, and results are shown in FIGS. 6 through 9.

Figure 6:
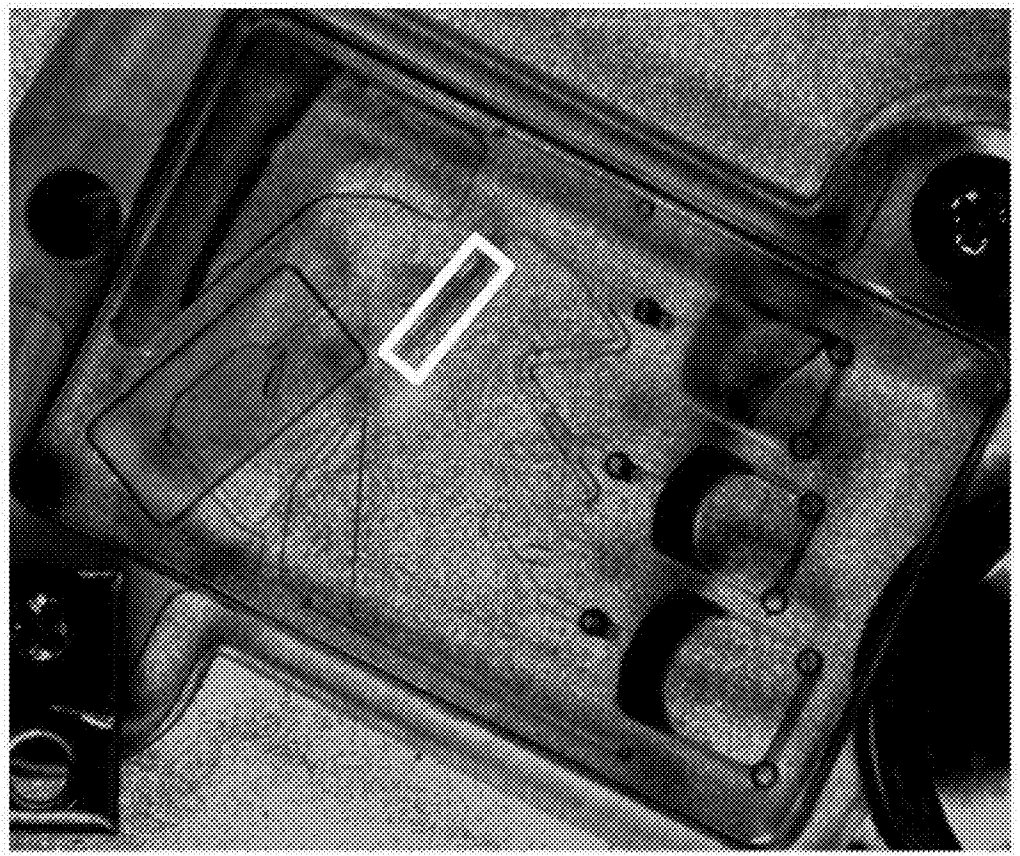
FIG. 6 is a photograph showing effects of removal of bubbles from a microfluidic channel according to an embodiment.
Figure 7:
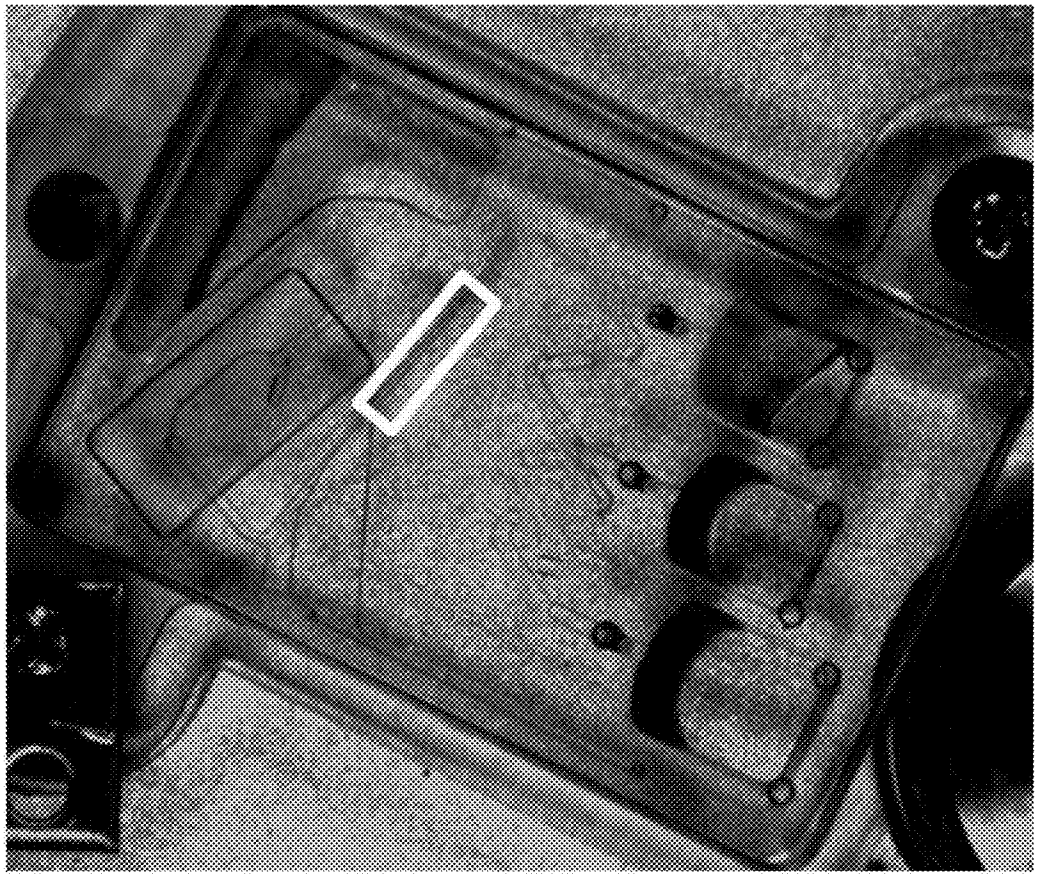
FIG. 7 is another photograph showing effects of removal of bubbles from the microfluidic channel according to the embodiment.
Figure 8:
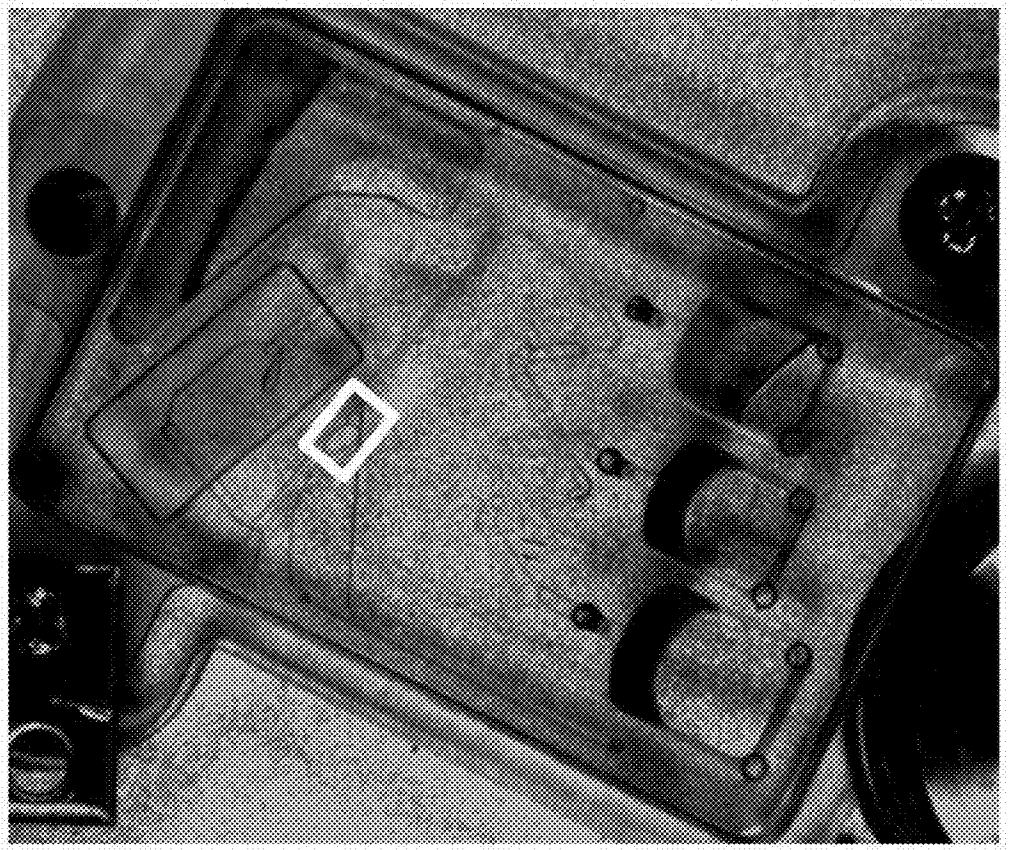
FIG. 8 is another photograph showing effects of removal of bubbles from the microfluidic channel according to the embodiment.
Figure 9:
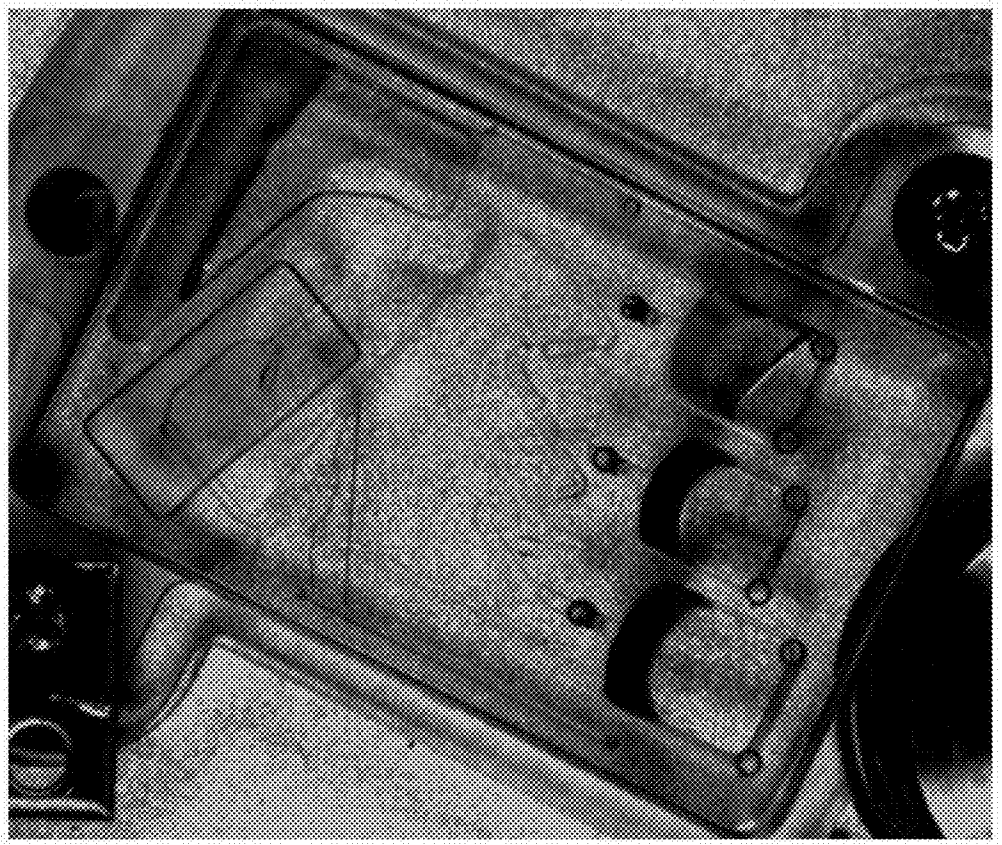
FIG. 9 is another photograph showing effects of removal of bubbles from the microfluidic channel according to the embodiment.

From FIGS. 6 through 8, it is observed that a gas is separated from a liquid due to a difference between pressures applied to the gas and the liquid in a microfluidic channel, and is moved to the top of the microfluidic channel, as indicated by the white outlined boxes. While moving toward a ventilating hole connected to the outside of a cartridge, the separated gas of FIG. 9 is removed.

Therefore, it can be seen that bubbles are effectively removed in the microfluidic channel having the gradually expanded cross-sectional area.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A microfluidic apparatus with a channel that removes bubbles from a fluid, the apparatus comprising:

a substrate with an axis of rotation;

a first channel having an upper wall, a lower wall opposite the upper wall, and a uniform cross-sectional area, wherein the upper wall is nearer the axis of rotation than the lower wall;

a second channel in fluid connection with the first channel, wherein the second channel has an upper wall extending from the upper wall of the first channel, a lower wall opposite the upper wall, and a cross-sectional area which increases in a flow direction away from the first channel; and a ventilation unit in fluid connection with the second channel, which extends outside the second channel from the terminal end of the upper wall of the second channel towards the axis of rotation.

2. The microfluidic apparatus of claim 1, wherein the material of the first and second channels comprises glass, silicon, silicon rubber, isobonyl acrylate, polyethylene terephthalate, polydimethylsiloxane, poly methyl methacrylate, polycarbonate, polypropylene, polystyrene, polyvinyl chloride, polysiloxane, polyimide and polyurethane, or any combination thereof.

3. The microfluidic apparatus of claim 1, wherein the apparatus is manufactured by a lamination process, a bonding process using an adhesive and surface reformation, or an ultrasonic fusion process.

4. The microfluidic apparatus of claim 1, further comprising a barrier positioned to hinder fluid flow from the first channel to the second channel, wherein the barrier is disposed at an end of the first channel adjacent the second channel, or within the second channel.

5. The microfluidic apparatus of claim 4, wherein the barrier includes polycaprolactone, polystyrene, propylene carbonate, ethylene carbonate, dimethylcarbonate, diethylcarbonate, dibutyl phthalate, dioctyl phthalate, diisooctyl phthalate, diheptylnonyl phthalate, tritolylphospate and dioctyl adipate, or any combination thereof.

6. The microfluidic apparatus of claim 1, wherein the ventilation unit has a curved shape.

7. The microfluidic apparatus of claim 1 further comprising:

a fluid injector;

a fluid container which is in fluid connection with the fluid injector, wherein the first channel of the microfluidic apparatus is in fluid connection with the fluid container; and a valve which controls fluid flow from the fluid container to the first channel.

8. The microfluidic apparatus of claim 7, further comprising a barrier positioned to hinder fluid flow from the first channel to the second channel, wherein the barrier is disposed at an end of the first channel adjacent the second channel, or within the second channel.

9. The microfluidic apparatus of claim 8, wherein the barrier includes polycaprolactone, polystyrene, propylene carbonate, ethylene carbonate, dimethylcarbonate, diethylcarbonate, dibutyl phthalate, dioctyl phthalate, diisooctyl phthalate, diheptylnonyl phthalate, tritolylphospate and dioctyl adipate, or any combination thereof.

10. The microfluidic apparatus of claim 7, wherein the ventilation unit extends from the terminal end of the upper wall of the second channel towards the axis of rotation.

11. The microfluidic apparatus of claim 10, wherein the ventilation unit has a curved shape.

12. A method of removing bubbles from a fluid comprising introducing a fluid into the first channel of the microfluidic apparatus of claim 1 and rotating the apparatus about the axis of rotation to flow fluid through the first and second channels.

13. The method of claim 12, wherein the fluid comprises protein, deoxyribonucleic acid, ribonucleic acid, peptides, carbohydrates, bacteria, plants, mold, animal cells, or any combination thereof.

14. A method of removing bubbles from a fluid comprising introducing a fluid into the first channel of the microfluidic apparatus of claim 7 and rotating the apparatus about the axis of rotation to flow fluid through the first and second channels.

15. The method of claim 14, wherein the fluid comprises protein, deoxyribonucleic acid, ribonucleic acid, peptides, carbohydrates, bacteria, plants, mold, animal cells, or any combination thereof.

16. The method of claim 12, wherein the fluid comprises a gas bubble and the flow of the fluid through the first channel toward the second channel removes the gas bubble from the fluid.

17. The method of claim 14, wherein the fluid comprises a gas bubble and the flow of the fluid through the first channel toward the second channel removes the gas bubble from the fluid.

* * * * *